US010518929B2

(12) United States Patent
Schuver

(10) Patent No.: US 10,518,929 B2
(45) Date of Patent: Dec. 31, 2019

(54) RESEALABLE BEVERAGE CAN LID

(71) Applicant: Steven S Schuver, St. Louis, MO (US)

(72) Inventor: Steven S Schuver, St. Louis, MO (US)

( * ) Notice: Subject to any disclaimer, the term of this patent is extended or adjusted under 35 U.S.C. 154(b) by 0 days.

(21) Appl. No.: 15/990,333

(22) Filed: May 25, 2018

(65) Prior Publication Data

US 2019/0283926 A1 Sep. 19, 2019

Related U.S. Application Data

(63) Continuation-in-part of application No. 15/923,789, filed on Mar. 16, 2018.

(51) Int. Cl.
*B65D 17/28* (2006.01)
*B65D 17/347* (2006.01)

(52) U.S. Cl.
CPC ..... *B65D 17/4014* (2018.01); *B65D 17/347* (2018.01); *B65D 2517/0044* (2013.01)

(58) Field of Classification Search
CPC ..... B65D 17/00–4014; B65D 2517/00–0044; B65D 33/25; B65D 77/2004; B65D 2501/24178; B65D 2517/0025; B65D 5/4266; B65D 5/701; B65D 5/703; B65D 5/705; B65D 5/706
See application file for complete search history.

(56) References Cited

U.S. PATENT DOCUMENTS 3,805,989 A 4/1974 Walker
3,845,880 A * 11/1974 Cole, Jr. ..... B65D 7/42 220/258.5
3,912,115 A * 10/1975 Smith ..... B65D 17/4012 220/277
3,967,752 A 7/1976 Cudzik
4,339,053 A * 7/1982 Tarro ..... B65D 17/4014 220/269
4,433,792 A 2/1984 Mandel
4,717,039 A * 1/1988 Ayyoubi ..... B65D 47/265 220/253
4,852,763 A * 8/1989 Dimberio ..... B65D 47/265 220/253
4,887,712 A 12/1989 Wells
5,351,853 A 10/1994 Shock
5,452,818 A 9/1995 Yost
5,647,497 A * 7/1997 Labbe ..... B65D 51/185 220/257.2
6,626,314 B1 * 9/2003 McHenry ..... B65D 47/265 220/254.2
9,315,305 B2 4/2016 Robinson
10,232,993 B2 * 3/2019 Seiders ..... A47G 19/2272
(Continued)

*Primary Examiner* — Kareen K Thomas
(74) *Attorney, Agent, or Firm* — David H. Chervitz

(57) ABSTRACT

A resealable beverage can lid is disclosed having a lid having a top side having a scored opening and a bottom side, a first rivet formed in the lid and extending outwardly from the top side of the lid, the first rivet having an indentation formed in the bottom side of the lid, a tab portion connected to the first rivet, the tab portion being magnetized, a second rivet formed in the lid and extending outwardly from the bottom side of the lid, the second rivet having an indentation formed in the top side of the lid, the second rivet being offset from the first rivet, and a closure element connected to the second rivet, movement of the tab portion capable of moving the closure element.

20 Claims, 9 Drawing Sheets

(56) References Cited

U.S. PATENT DOCUMENTS

| | | | | |
|---|---|---|---|---|
| 2004/0256388 | A1 | 12/2004 | Rossetti et al. | |
| 2007/0108208 | A1* | 5/2007 | Dickie | B65D 17/4012 220/269 |
| 2008/0217347 | A1* | 9/2008 | Markaj | B65D 17/4014 220/713 |
| 2013/0087563 | A1 | 4/2013 | Brandtner | |

* cited by examiner

RESEALABLE BEVERAGE CAN LID

CROSS REFERENCE TO RELATED APPLICATIONS

This application is a continuation-in-part of U.S. patent application Ser. No. 15/923,789 filed on Mar. 16, 2018.

BACKGROUND

This disclosure relates generally to a beverage can lid having an opening, and more particularly to a resealable beverage can lid.

Beverage cans for containing liquids such as a carbonated beverages have become a universal and ubiquitous product. The beverage can is typically constructed of an aluminum alloy composition that may include aluminum, magnesium, manganese, silicon, and copper. The beverage can consists of a can body into which a liquid is filled and a can lid that is sealed to the can body. The can body may include a base or bottom that is dome shaped to resist internal pressure, a generally cylindrical section, a narrowed neck portion, and an open top edge. The can lid may include the lid portion that is about the same circumference as the narrowed neck portion of the can body, a scored opening or weakened portion, a tab portion that is used to open the scored opening portion, and a rivet that is used to secure the tab to the lid portion. The rivet is an integral piece of the lid portion and is formed by stretching the center of the lid portion upwardly and then drawn to form the rivet. The lid is sealed to the can body by trimming the open top edge of the can body, bending the trimmed edge, and seaming the bent trimmed edge to the lid. In this manner, any liquid contained within the can body is sealed. To open the beverage can the tab is lifted to press against the scored opening portion to partially push the scored opening portion into the can body to create an opening in the lid. The scored opening portion typically does not fully detach from the lid. Once opened, liquid from inside the can body may flow through the opening.

One problem associated with the use of the beverage can is that once opened it cannot be closed again. Since the liquid within the beverage can may be carbonated, after a period of time the carbonation escapes and the liquid becomes flat or stale. Once flat, the beverage can and its contents may be discarded which may be wasteful. Also, after opening the beverage can the contents may have to be consumed quickly because the contents cannot be preserved. Further, it is also possible that the contents of the beverage can may spill due to not being able to close the opening. In particular, when an individual is walking with an opened can the individual may trip or fall and the contents of the can may be spilled because the can is open. This may also be problematic if the beverage can is stationary and near electrical equipment such as a computer or a laptop and the can accidentally is knocked over. It is also possible that insects or other contaminants may infiltrate the beverage can through the opening. If this occurs then the beverage can and its contents should be thrown away.

The present disclosure is designed to obviate and overcome many of the disadvantages and shortcomings experienced with prior beverage can constructions. Particularly, it would be advantageous to be able to have a resealable beverage can lid for preserving the contents of the beverage can. Moreover, the present disclosure is related to a resealable beverage can lid that can be easily resealed for later use.

SUMMARY

In one form of the present disclosure, a resealable beverage can lid is disclosed which comprises a lid having a top side having a scored opening and a bottom side, a first rivet formed in the lid and extending outwardly from the top side of the lid, the first rivet having an indentation formed in the bottom side of the lid, a tab portion connected to the first rivet, the tab portion being magnetized, a second rivet formed in the lid and extending outwardly from the bottom side of the lid, the second rivet having an indentation formed in the top side of the lid, the second rivet being offset from the first rivet, and a closure element connected to the second rivet, movement of the tab portion capable of moving the closure element.

In another form of the present disclosure, a resealable beverage can lid comprises a lid having a top side having a scored opening and a bottom side, a first rivet formed in the lid and extending outwardly from the top side of the lid, the first rivet having an indentation formed in the bottom side of the lid, a tab portion connected to the first rivet, a second rivet formed in the lid and extending outwardly from the bottom side of the lid, the second rivet having an indentation formed in the top side of the lid, the second rivet being offset from the first rivet, and a closure element connected to the second rivet, the closure element being magnetized with movement of the tab portion capable of moving the closure element.

In still another form of the present disclosure, a resealable beverage can lid is disclosed which comprises a lid having a top side having a scored opening and a bottom side, a first rivet formed in the lid and extending outwardly from the top side of the lid, the first rivet having an indentation formed in the bottom side of the lid, a tab portion connected to the first rivet, the tab portion being magnetized, a second rivet formed in the lid and extending outwardly from the bottom side of the lid, the second rivet having an indentation formed in the top side of the lid, the second rivet being offset from the first rivet, a closure element connected to the second rivet, movement of the tab portion capable of moving the closure element, and a guide track formed in the bottom side of the lid for guiding movement of the closure element.

In light of the foregoing comments, it will be recognized that the resealable beverage can lid of the present disclosure is of simple construction and design and which can be easily employed with highly reliable results.

The present disclosure provides a resealable beverage can lid that may be used to reseal an opened beverage can in order to preserve the contents of the beverage can for later use.

The present disclosure provides a resealable beverage can lid that employs an easy to use adjustment mechanism that allows an individual to reseal the lid of an opened beverage can.

The present disclosure provides a resealable beverage can lid that does not require any special tools to open or operate the resealable beverage can lid.

The present disclosure also provides a resealable beverage can lid that can be used with any size beverage cans.

The present disclosure provides a resealable beverage can lid that can be constructed using readily available materials and construction techniques and machinery.

The present disclosure also provides a resealable beverage can lid having a closure mechanism that does not add significantly to the price of manufacturing the beverage can lid.

These and other advantages of the present disclosure will become apparent after considering the following detailed specification in conjunction with the accompanying drawings, wherein:

DETAILED DESCRIPTION OF A PREFERRED EMBODIMENT

Figure 1:
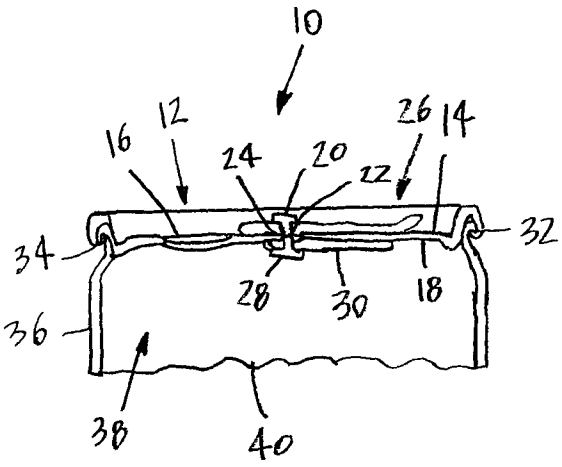
FIG. 1 is a partial cross-sectional view of a beverage can having a resealable beverage can lid constructed according to the present disclosure connected to the beverage can.

Referring now to the drawings, wherein like numbers refer to like items, number 10 identifies a preferred embodiment of a resealable beverage can lid constructed according to the present disclosure. Referring now to FIG. 1, the resealable beverage can lid 10 is shown to comprise a lid 12 having a top side 14 having a first scored opening 16 and a bottom side 18. The lid 12 has a first rivet 20 formed therein with the first rivet 20 extending outwardly from the top side 14 of the lid 12. The first rivet 20 has an indentation 22 formed in the bottom side 18 of the lid 12 during the manufacturing process that forms the first rivet 20. The first rivet 20 has a scored first circumference 24. The scored first circumference 24 may be formed in the top side 14 or the bottom side 18. The scored first circumference 24, once ruptured, released, or broken from the lid 12, allows the first rivet 20 to be freed from the lid 12 so that the first rivet 20 is able to rotate about the lid 12, as will be explained more fully herein. A tab portion 26 is connected to the first rivet 20. The tab portion 26 is used to open the first scored opening 16 to form an opening (not shown) in the lid 12. The tab portion 26 may be connected to the first rivet 20 by friction, welding, or adhesive. A rotational force may be applied by rotating the tab portion 26 to release the first rivet 20 from the lid 12 by use of the scored first circumference 24. A second rivet 28 is connected to the first rivet 20 at the indentation 22. The second rivet 28 may be connected to the first rivet 20 by welding or use of an adhesive. A closure device or element 30 is connected to the second rivet 28. The closure element 30 may be connected to the second rivet by friction, welding, or adhesive. The closure element 30 is sized and shaped generally the same as the first scored opening 16.

The lid 12 has a flange 32 that is shaped to receive a neck portion 34 of a cylindrical can body 36. The can body 36 has an interior 38 in which a liquid 40, such as a carbonated beverage, may be filed. As can be appreciated, the lid 12 is used to seal or cap the neck portion 34 of the can body 36. The closure element 30 is initially positioned to be away from the first scored opening 16 so as not to interfere with the operation of the first scored opening 16. The tab portion 26 is operated to rupture the first scored opening 16 to move the first scored opening 16 into the interior 38 of the can body 36. An opening (not shown) is created after the first scored opening 16 is moved into the interior 38.

Figure 2:
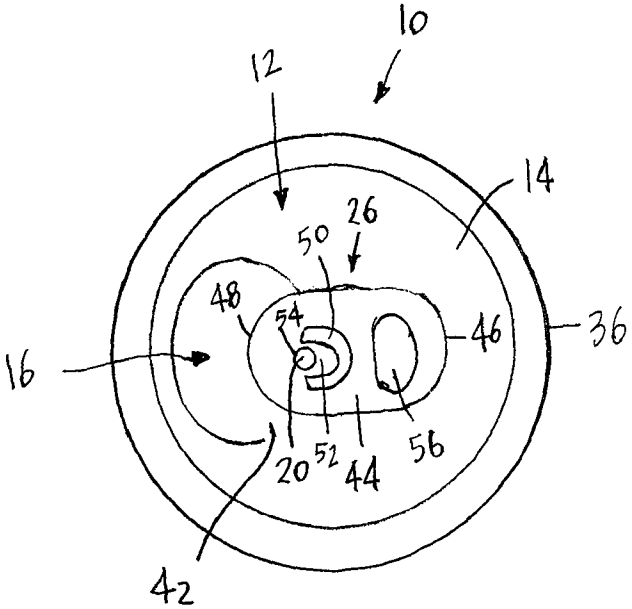
FIG. 2 is a top view of the resealable beverage can lid shown in FIG. 1.

FIG. 2 shows a top view of the resealable beverage can lid 10 constructed according to the present disclosure. The resealable beverage can lid 10 has the lid 12 having the top side 14 having the first scored opening 16, the first rivet 20, and the tab portion 26. The lid 12 has a portion or area 42 that is not scored. The portion 42 prevents the first scored opening 16 from falling completely into the interior 38 (FIG. 1) of the can body 36. In essence, the first scored opening 16 is held in place on the lid 12 by the portion 42 with the portion 42 acting as a hinge. The tab portion 26 comprises a main body portion 44 having a rear lifting portion 46 and a forward rupturing portion 48. A generally U-shaped opening 50 is used to form a generally semicircular portion 52 that has an aperture 54 formed therein for receiving the first rivet 20. The first rivet 20 may be connected to the semicircular portion 52 at the aperture 54. As previously indicated, the first rivet 20 may be connected by welding, adhesive, or frictional engagement. An opening 56 is also formed in the rear lifting portion 46.

Figure 3:
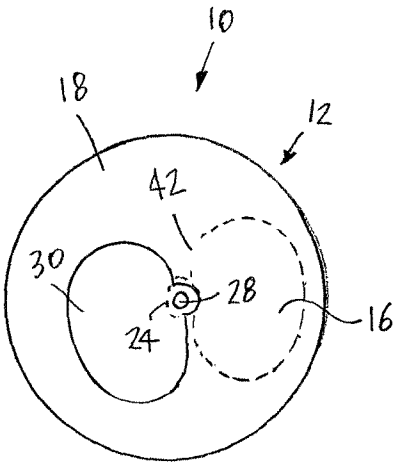
FIG. 3 is a bottom view of the resealable beverage can lid shown in FIG. 1.

With reference now to FIG. 3, a bottom view of the resealable beverage can lid 10 is illustrated. The resealable beverage can lid 10 has the bottom side 18 of the lid 12 and the closure element 30 connected to the second rivet 28. The first scored opening 16 and the scored first circumference 24 are both shown in phantom in this particular view. The first scored opening 16 also has the portion 42 that remains connected to the lid 12. The closure element 30 is positioned in an initial or opened position against the bottom side 18 of the lid 12. The closure element 30 is capable of rotation by use of the tab 26 (FIG. 1), first rivet 20 (FIG. 1), and the second rivet 28 once the scored first circumference 24 has been ruptured. The first scored opening 16 is also shown in a closed position before the lid 12 is opened.

Figure 4:
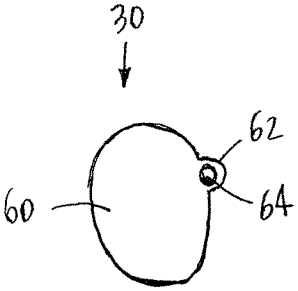
FIG. 4 is a bottom view of a closure device constructed according to the present disclosure.

FIG. 4 depicts a top view of the closure element 30. The closure element 30 has a main body portion 60 having an extension portion 62 having an aperture 64 for receiving the second rivet 28. The main body portion 60 is shown being generally oval in shape, however, any shape that is capable of covering any opening formed in the lid 12 may be used. The extension portion 62 is generally circular in shape. However, any shape may be used for the extension portion 62.

Figure 5:
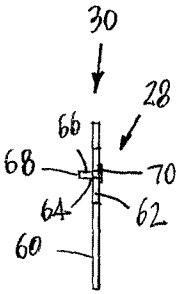
FIG. 5 is a cross-sectional side view of the closure device connected to the rivet constructed according to the present disclosure.

Referring now to FIG. 5, a side view of the closure element 30 having the second rivet 28 inserted therein is shown. The closure element 30 has the main body portion 60, the extension portion 62, and the second rivet 28 inserted through the aperture 64 formed in the extension portion 62. The second rivet 28 has a shank portion 66 having an end 68 and a head portion 70 connected to the shank portion 66. The end 68 may be connected to the first rivet 20 (FIG. 1) or the indentation 22 (FIG. 1).

Figure 6:
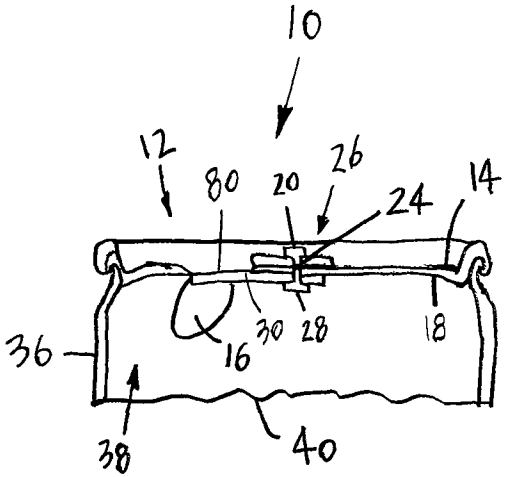
FIG. 6 is a partial cross-sectional view of the beverage can having the resealable beverage can lid constructed according to the present disclosure connected to the beverage can with the closure device being shown in a closed position and a scored opening portion being shown in an opened position.

FIG. 6 illustrates the closure element 30 of the resealable beverage can lid 10 being in a closed position and the first scored opening 16 being in an opened position. The resealable beverage can lid 10 is shown having the lid 12 having the top side 14 having the first scored opening 16 being pushed into the interior 38 of the can body 36. By having the first scored opening 16 being in the opened position an opening 80 is created in the top side 14 of the lid 12. Once this occurs the contents or the liquid 40 within the can body 36 may be emptied. The lid 12 also has the bottom side 18 against which is located the closure element 30 which is shown being moved into a closed position covering the opening 80. The tab portion 26 is also shown being rotated relative to the lid 12 to rotate the closure element 30 into the closed position. The tab portion 26 is connected to the first rivet 20, the closure element 30 is connected to the second rivet 28, and the second rivet 28 is connected to the first rivet 20. These connections provide rotation of the closure element 30 into the closed or opened positions. Further, the tab portion 26 is used to initially break the scored first circumference 24 from the lid 12. Once the bond between the lid 12 and the scored first circumference 24 is broken the tab portion 26 is able to rotate the closure element 30 to cover or uncover the opening 80.

Figure 7:
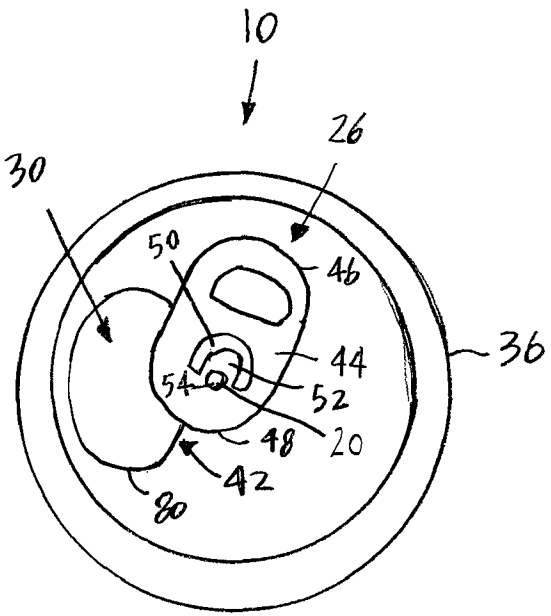
FIG. 7 is a top view of the resealable beverage can lid showing the closure device in a closed position.

With reference now to FIG. 7, a top view of the resealable beverage can lid 10 is illustrated with the closure element 30 being in the closed position. The closure element 30 has sealed off the opening 80 and any contents within the can body 36 are not able to escape or be spilled. The closure element 30 is capable of abutting the portion 42. The tab portion 26 has the main body portion 44 having the rear lifting portion 46 and the forward rupturing portion 48. The generally U-shaped opening 50 is used to form the generally semicircular portion 52 that has the aperture 54 formed therein for receiving the first rivet 20. The first rivet 20 may be connected to the semicircular portion 52 at the aperture 54. It should be noted that the tab portion 26 has been rotated or moved with respect to an initial position or condition of the tab portion 26, as shown in FIG. 2. As has been discussed, rotation of the tab portion 26 moves the closure element 30 into the closed position. Returning the tab portion 26 to its initial position will move or rotate the closure element 30 into an opened position in which the opening 80 is unblocked. With the opening 80 unblocked, the contents of the can body 36 may be removed, used, or emptied.

The operation of the resealable beverage can lid 10 may be as follows. The can body 36 is filled with the liquid 40 and the lid 12 is sealed to the can body 36 and the product is then made available for purchase by an individual or consumer. Once purchased and the individual wants to use the product the individual will lift the rear lifting portion 46 of the tab portion 26 which causes the forward rupturing portion 48 to press against the first scored opening 16 to move the first scored opening 16 into the interior 38 of the can body 36 to create the opening 80. Once the can body 36 has been opened the rear lifting portion 46 of the tab portion 26 is released which causes the tab portion 26 to return to an initial position. The opening 80 allows the individual to drink the liquid 40 from the can body 36. When the individual wants to close the opening 80 the individual may grasp the rear lifting portion 46 of the tab portion 26 to initially rupture the scored first circumference 24 by rotating the tab portion 26. Further rotation of the tab portion 26 causes the closure element 30 to move into the closed position to cover the opening 80. The can body 36 may be held, stored, or refrigerated without fear of the liquid 40 spilling out of the can body 36 or the liquid 40 becoming stale. When the individual desires to again drink from the can body 36 the individual holds the rear lifting portion 46 and rotates the tab portion 26 to move the closure element 30 into the open position uncovering the opening 80. As is known, once the liquid 40 from the can body 36 has been consumed, the can body 36 may be recycled.

Figure 8:
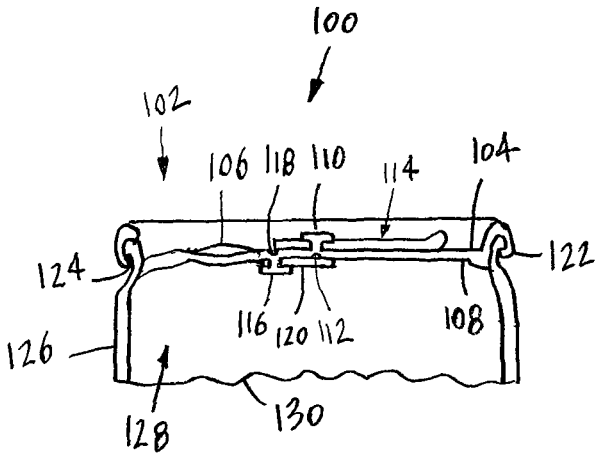
FIG. 8 is a partial cross-sectional view of another preferred embodiment of a beverage can having a resealable beverage can lid constructed according to the present disclosure connected to the beverage can.

FIG. 8 is a partial cross-sectional view of another embodiment of a resealable beverage can lid 100 constructed according to the present disclosure. The resealable beverage can lid 100 is shown to comprise a lid 102 having a top side 104 having a scored opening 106 and a bottom side 108. The lid 102 has a first rivet 110 formed therein with the first rivet 110 extending outwardly from the top side 104 of the lid 102. The first rivet 110 has an indentation 112 formed in the bottom side 108 of the lid 102 during the manufacturing process that forms the first rivet 110. A tab portion 114 is connected to the first rivet 110. The tab portion 114 is magnetized or may be of a material that may be magnetized. Further, it is possible and contemplated that the tab portion 114 may include a magnet or a portion of a magnet. The tab portion 114 is used to open the scored opening 106 to form an opening (not shown) in the lid 102. The tab portion 114 may be rotated about the first rivet 110. A second rivet 116 is formed in the lid 102 with the second rivet 116 extending outwardly form the bottom side 108 of the lid 102. The second rivet 116 has an indentation 118 formed in the top side 104 of the lid 102 during the manufacturing process that forms the second rivet 116. A closure device or element 120 is connected to the second rivet 116 to position the closure element 118 on the bottom side 108 of the lid 102. The closure element 120 is able to rotate freely about the second rivet 116. The closure element 120 may be constructed of a material that is magnetized or may be magnetized. Also, it is possible that the closure element 120 may include a magnet or a portion of a magnet The closure element 120 is sized and shaped generally the same as the scored opening 106.

The lid 102 has a flange 122 that is shaped to receive a neck portion 124 of a cylindrical can body 126. The can body 126 has an interior 128 in which a liquid 130, such as a carbonated beverage, may be filed. As can be appreciated, the lid 102 is used to seal or cap the neck portion 124 of the can body 126. The closure element 120 is initially positioned to be away from the scored opening 106 so as not to interfere with the operation of the scored opening 106. The tab portion 114 is operated to rupture the scored opening 106 to move the scored opening 106 into the interior 128 of the can body 126. An opening (not shown) is created after the scored opening 106 is moved into the interior 128. The tab portion 114 is used to rotate the closure element 120 into a closed position to close or seal the opening formed in the lid 102 after the scored opening 106 is moved into the interior 128. The tab portion 114 will magnetically interact with the closure element 120 and movement of the tab portion 114 will move or rotate the closure element 120 into a closed position or an opened position.

Figure 9:
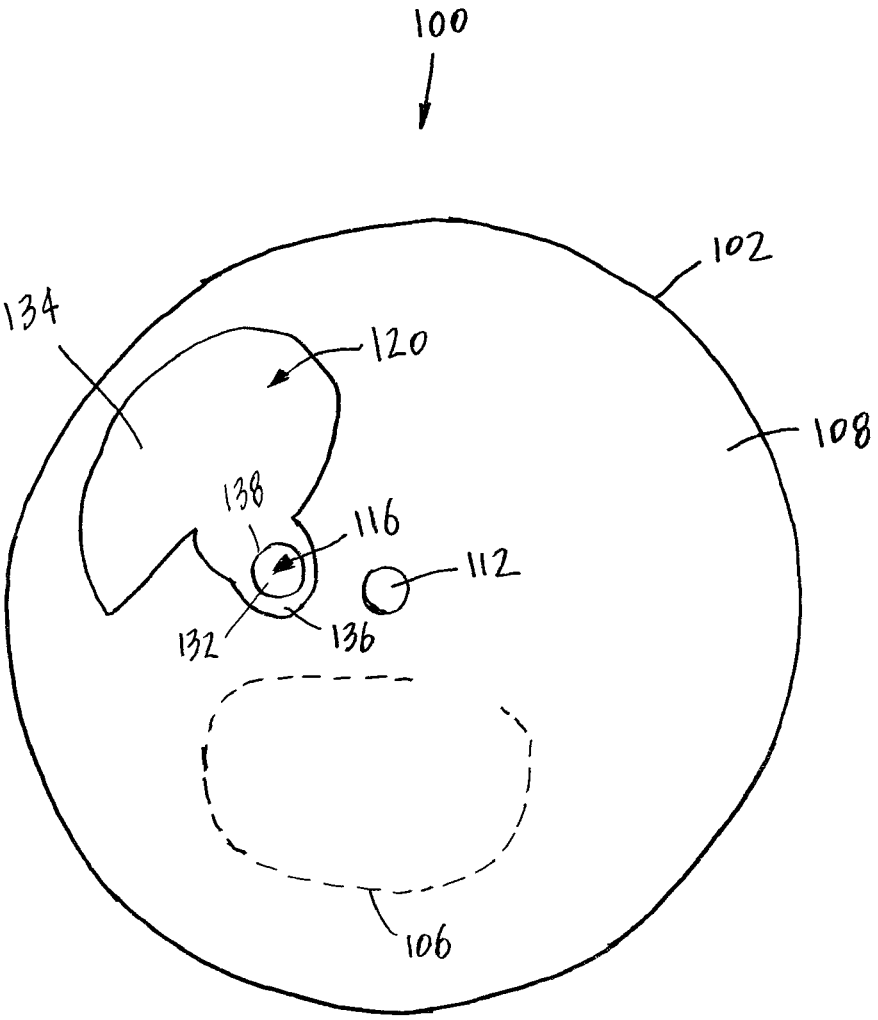
FIG. 9 is an enlarged bottom view of the resealable beverage can lid shown in FIG. 8 constructed according to the present disclosure.

FIG. 9 illustrates an enlarged bottom view of the resealable beverage can lid 100 shown in FIG. 8. The resealable beverage can lid 100 has the lid 102 having the bottom side 108 having the indentation 112 formed therein. The scored opening 106 is also shown in phantom in this particular view. The closure element 120 is shown being held in place by the second rivet 116. The second rivet 116 is offset from the indentation 112 or the first rivet (not shown). The second rivet 116 has a rivet head 132 that secures the closure element 120 in place. The closure element 120 has a main body portion 134 having an extension portion 136. Although hidden in view by the rivet head 132, the closure element has an aperture 138 for receiving the second rivet 116 and for allowing the closure element 120 to rotate about the second rivet 116. The main body portion 134 is shown being generally oval in shape, however, any shape that is capable of covering any opening formed in the lid 102 after the scored opening 106 has been ruptured may be used. The extension portion 136 is generally circular in shape. However, any suitable shape may be used for the extension portion 136.

Figure 10:
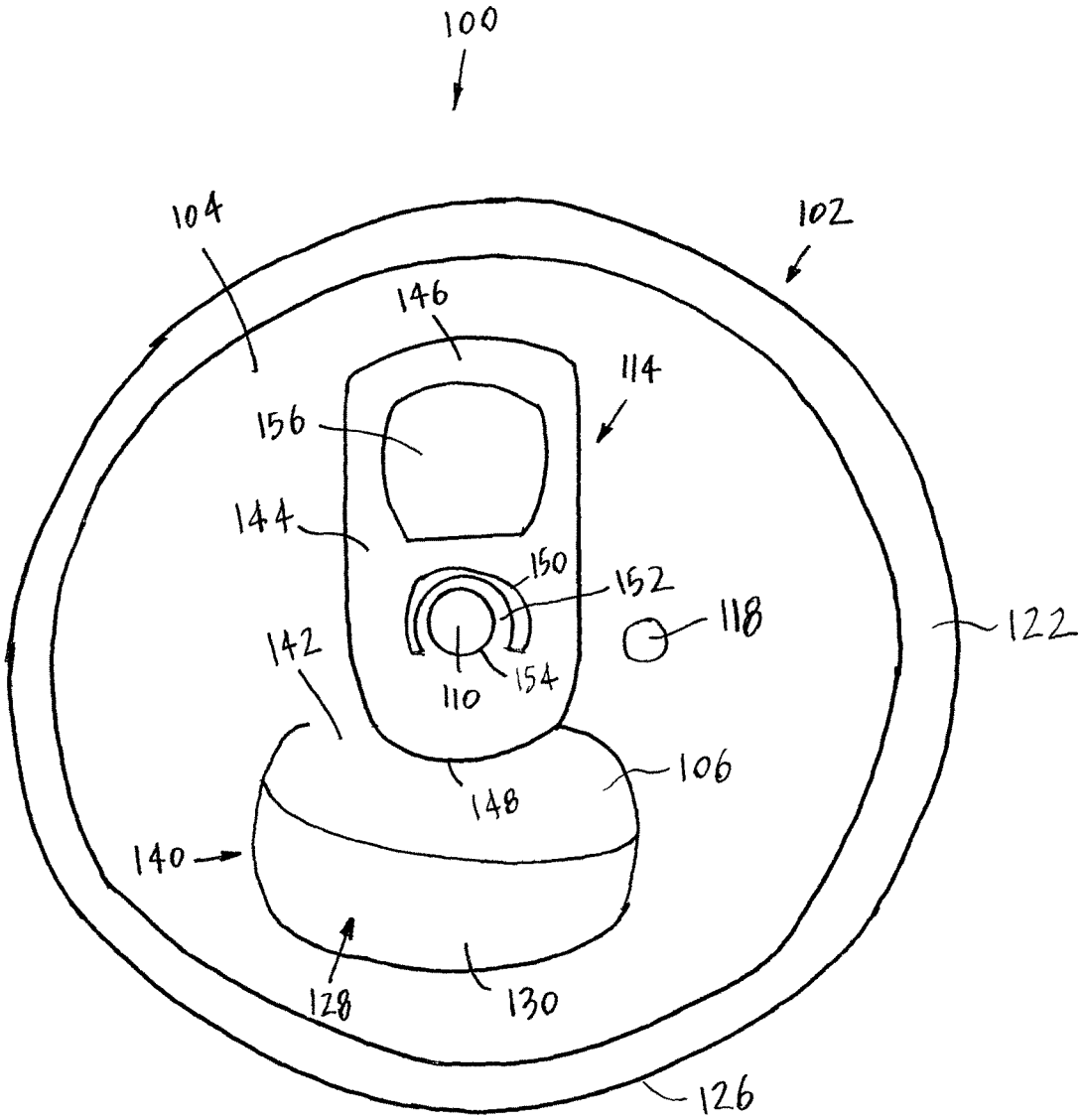
FIG. 10 is an enlarged top view of the resealable beverage can lid shown in FIG. 8 constructed according to the present disclosure with a scored opening being ruptured.

Referring now to FIG. 10, an enlarged top view of the resealable beverage can lid 100 shown is in FIG. 8 is illustrated. The resealable beverage can lid 100 is depicted having the lid 102 having the top side 104 having the tab portion 114 held in place by the first rivet 110. The indentation 118 created with the formation of the second rivet 116 (not shown) is also shown in the top side 104 of the lid 102. The flange 122 is further visible in this view. The scored opening 106 has been ruptured to leave an opening 140 in the lid 102 for beverage 130 to flow out of the interior 128 of the can body 126. The lid 102 has a portion or area 142 that is not scored. The portion 142 prevents the scored opening 106 from falling completely into the interior 128 of the can body 126. In essence, the scored opening 106 is held in place on the lid 102 by the portion 142 with the portion 142 acting as a hinge. The tab portion 114 comprises a main body portion 144 having a rear lifting portion 146 and a forward rupturing portion 148. A generally U-shaped opening 150 is used to form a generally semicircular portion 152 that has an aperture 154 formed therein for receiving the first rivet 110. The tab portion 114 is capable of rotating about the first rivet 110 and the tab portion 114 is shown in an initial condition or position. An opening 156 may also be formed in the rear lifting portion 146.

Figure 11:
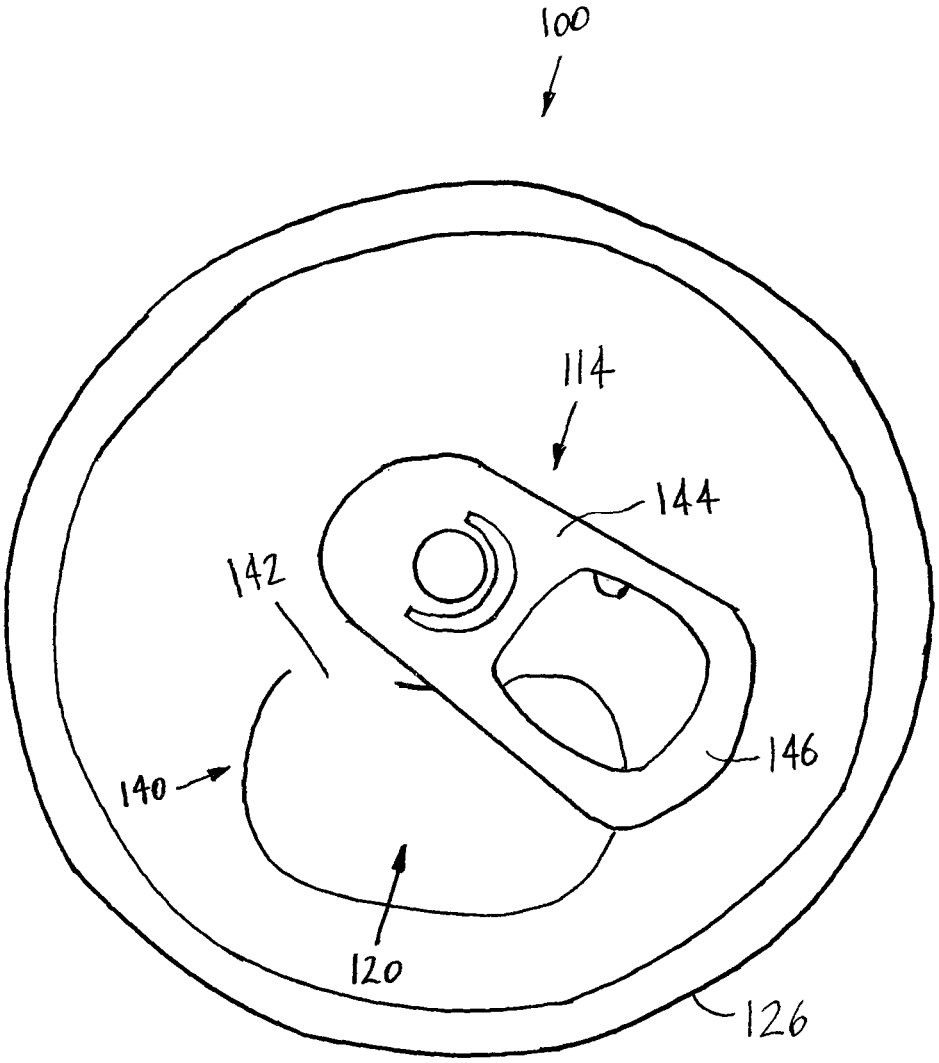
FIG. 11 is an enlarged top view of the resealable beverage can lid shown in FIG. 8 constructed according to the present disclosure with the scored opening being ruptured and a closure member covering the scored opening.

FIG. 11 shows a top view of the resealable beverage can lid 100 with the closure element 120 being in the closed position covering the opening 140. The closure element 120 has sealed off the opening 140 and any contents within the can body 126 are not able to escape or be spilled. The closure element 120 is capable of abutting the portion 142. The tab portion 114 has been moved or rotated with the rear lifting portion 146 of the main body portion 144 partially over the opening 140 and the closure element 120. In essence, the tab portion 114 has been rotated or moved with respect to an initial position or condition of the tab portion 114, as shown in FIG. 10. As has been discussed, rotation of the tab portion 114 magnetically moves the closure element 120 into the closed position. Returning the tab portion 114 to its initial position will move or rotate the closure element 120 into an opened position in which the opening 140 is unblocked. As can be appreciated, with the opening 140 unblocked, the contents of the can body 126 may be removed, used, or emptied.

The operation of the resealable beverage can lid 100 may be accomplished as follows. The can body 126 is filled with the liquid 130 and the lid 102 is sealed to the can body 126 and the product is then made available for purchase by an individual or consumer. Once purchased and the individual wants to use the product the individual will lift the rear lifting portion 146 of the tab portion 114 which causes the forward rupturing portion 148 to press against the scored opening 106 to move the scored opening 106 into the interior 128 of the can body 126 to create the opening 140. Once the can body 126 has been opened the rear lifting portion 146 of the tab portion 114 is released which causes the tab portion 114 to return to an initial position. The opening 140 allows the individual to drink the liquid 130 from the can body 126. When the individual wants to close the opening 140 the individual may grasp the rear lifting portion 146 of the tab portion 114 and rotate the tab portion 114 which magnetically rotates the closure element 120. Rotation of the tab portion 114 to the position shown in FIG. 11 causes the closure element 120 to move into the closed position to cover the opening 140. The can body 126 may be held, stored, or refrigerated without fear of the liquid 130 spilling out of the can body 126 or the liquid 130 becoming stale. When the individual desires to again drink from the can body 126 the individual holds the rear lifting portion 146 and rotates the tab portion 114 back to the original position as depicted in FIG. 10 to move the closure element 120 back into the open position uncovering the opening 140. As is known, once the liquid 130 from the can body 126 has been consumed, the can body 126 may be recycled.

Figure 12:
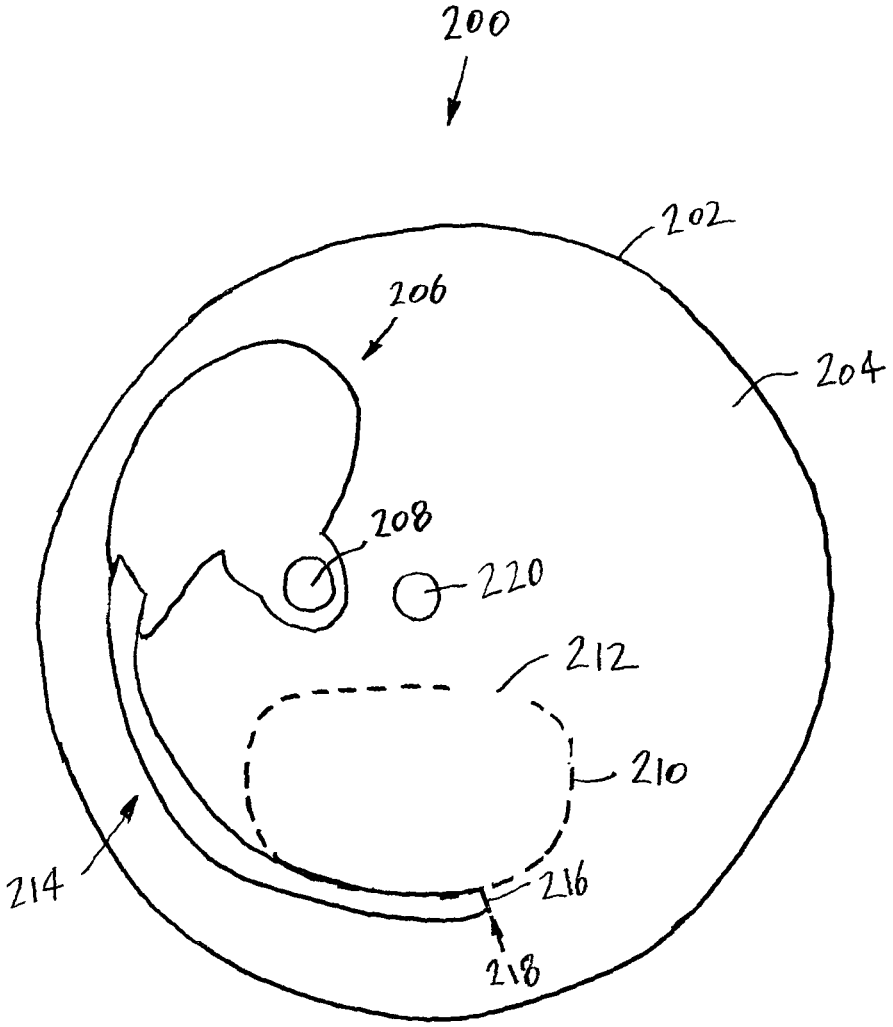
FIG. 12 is a bottom view of another preferred embodiment of a resealable beverage can lid constructed according to the present disclosure.

FIG. 12 illustrates a bottom view of another preferred embodiment of a resealable beverage can lid 200. The resealable beverage can lid 200 has a lid 202 having a bottom side 204 having a closure element 206 connected to a rivet 208. A scored opening 210 is shown in phantom in this particular view. The scored opening 210 also has a portion 212 that remains connected to the lid 202 when the scored opening 210 has been opened, as has been previously indicated. The bottom side 204 also has a guide track 214 formed in the bottom side 204 of the lid 202 for guiding movement of the closure element 206. The guide track 214 may be in the form of a raised rib that is formed from the material of the lid 202 or the guide track 214 may be a separate element that is adhered or welded to the lid 202. The guide track 214 may also have a stop 216 at an end 218 of the guide track 214. The stop 216 may be used to prevent the closure element 206 from moving past a certain point which might damage the closure element 206. The closure element 206 is positioned in an initial or opened position against the bottom side 204 of the lid 202. Although not shown in this particular view, the resealable beverage can lid 200 may also have a top side of the lid 202, another rivet which is indicated at an indention 220, and a tab portion connected to the other rivet. The closure element 206 may be magnetized and the tab portion (not shown) may also be magnetized. The closure element 206 is capable of being rotated into a closed position and back into the opened position by movement of the tab portion, as has been previously indicated.

Figure 13:
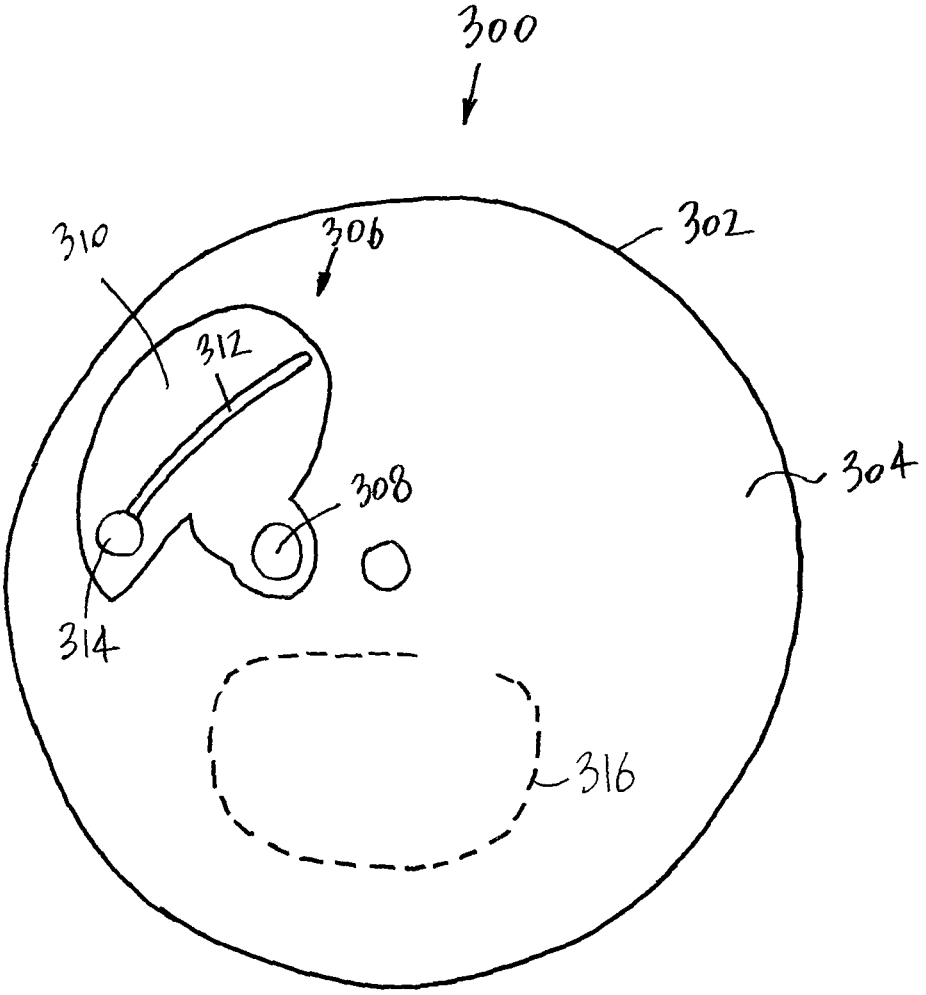
FIG. 13 is a bottom view of another preferred embodiment of a resealable beverage can lid constructed according to the present disclosure.

Referring now in particular to FIG. 13, a bottom view of another preferred embodiment of a resealable beverage can lid 300 constructed according to the present disclosure is shown. The resealable beverage can lid 300 has a lid 302 having a bottom side 304 having a closure element 306 connected to a second rivet 308. The closure element 306 has a main body 310 having a slot 312 formed therein. The slot 312 has a third rivet 314 captured therein. The third rivet 314 acts like a stop for controlling the range of movement of the closure element 306. The closure element 306 may be formed of a magnetic material. As should be appreciated by now, rotation of a tab member (not shown) will magnetically cause the closure element 306 to rotate to cover or uncover a scored opening 316, shown in phantom. The third rivet 314 is formed in the same manner as has been shown and described for the second rivet 116 (FIG. 9).

Preferably, the resealable beverage can lids 10, 100, 200, and 300 will be constructed of a relatively lightweight material so that it can be easily used and manufactured. By way of example only, the resealable beverage can lids 10, 100, 200, and 300 may be constructed of a metal that may be magnetized.

Although it has been indicated herein that the resealable beverage can lids 10, 100, 200, and 300 are used with cans that contain a liquid, such as a carbonated beverage, it is also possible and contemplated that the cans may contain other items such as powders, spices, foods, syrups, gums, candies, or any other item that can be removed from an opening in the lids 10, 100, 200, and 300.

From all that has been said, it will be clear that there has thus been shown and described herein a resealable beverage can lid which fulfills the various objects and advantages sought therefor. It will be apparent to those skilled in the art, however, that many changes, modifications, variations, and other uses and applications of the subject resealable beverage can lid are possible and contemplated. All changes, modifications, variations, and other uses and applications which do not depart from the spirit and scope of the disclosure are deemed to be covered by the disclosure, which is limited only by the claims which follow.

What is claimed is:

1. A resealable beverage can lid comprising:

a lid having a top side having a scored opening and a bottom side;

a first rivet formed in the lid and extending outwardly from the top side of the lid, the first rivet having an indentation formed in the bottom side of the lid;

a tab portion connected to the first rivet, the tab portion being magnetized;

a second rivet formed in the lid and extending outwardly from the bottom side of the lid, the second rivet having an indentation formed in the top side of the lid, the second rivet being offset from the first rivet; and a closure element connected to the second rivet, movement of the tab portion capable of moving the closure element.

2. The resealable beverage can lid of claim 1 wherein the closure element comprises a main body portion having an extension portion having an aperture for receiving the second rivet.

3. The resealable beverage can lid of claim 2 wherein the main body portion comprises a generally oval shape that is capable of covering an opening formed in the lid by rupturing the scored opening.

4. The resealable beverage can lid of claim 1 wherein the closure element is positioned at a first position and is moved to a second position.

5. The resealable beverage can lid of claim 1 further comprising a third rivet formed in the lid and extending outwardly from the bottom side of the lid and the closure element further comprising a slot with the third rivet positioned within the slot.

6. The resealable beverage can lid of claim 1 wherein the closure element is initially positioned in an opened position and is rotated to a closed position to cover an opening formed in the lid by rupturing the scored opening.

7. The resealable beverage can lid of claim 1 wherein the closure element comprises a main body portion having an extension portion having an aperture for receiving the second rivet and a slot formed in the main body portion.

8. A resealable beverage can lid comprising:

a lid having a top side having a scored opening and a bottom side;

a first rivet formed in the lid and extending outwardly from the top side of the lid, the first rivet having an indentation formed in the bottom side of the lid;

a tab portion connected to the first rivet;

a second rivet formed in the lid and extending outwardly from the bottom side of the lid, the second rivet having an indentation formed in the top side of the lid, the second rivet being offset from the first rivet; and a closure element connected to the second rivet, the closure element being magnetized with movement of the tab portion capable of moving the closure element.

9. The resealable beverage can lid of claim 8 wherein the closure element comprises a main body portion having an extension portion having an aperture for receiving the second rivet.

10. The resealable beverage can lid of claim 9 wherein the main body portion comprises a generally oval shape that is capable of covering an opening formed in the lid by rupturing the scored opening.

11. The resealable beverage can lid of claim 8 further comprising a third rivet formed in the lid and extending outwardly from the bottom side of the lid and the closure element further comprising a slot with the third rivet positioned within the slot.

12. The resealable beverage can lid of claim 8 wherein the closure element further comprises a magnet.

13. The resealable beverage can lid of claim 8 wherein the closure element is initially positioned in an opened position and is rotated to a closed position to cover the opening formed in the lid by rupturing the scored opening.

14. The resealable beverage can lid of claim 8 wherein the closure element is positioned at a first position and is moved to a second position.

15. The resealable beverage can lid of claim 8 wherein the closure element comprises a main body portion having an extension portion having an aperture for receiving the second rivet and a slot formed in the main body portion.

16. A resealable beverage can lid comprising:

a lid having a top side having a scored opening and a bottom side;

a first rivet formed in the lid and extending outwardly from the top side of the lid, the first rivet having an indentation formed in the bottom side of the lid;

a tab portion connected to the first rivet, the tab portion being magnetized;

a second rivet formed in the lid and extending outwardly from the bottom side of the lid, the second rivet having an indentation formed in the top side of the lid, the second rivet being offset from the first rivet;

a closure element connected to the second rivet, movement of the tab portion capable of moving the closure element; and a guide track formed in the bottom side of the lid for guiding movement of the closure element.

17. The resealable beverage can lid of claim 16 wherein the guide track further comprises an end having a stop.

18. The resealable beverage can lid of claim 17 wherein the main body portion comprises a generally oval shape that is capable of covering an opening formed in the lid by rupturing the scored opening.

19. The resealable beverage can lid of claim 16 wherein the closure element comprises a main body portion having an extension portion having an aperture for receiving the second rivet.

20. The resealable beverage can lid of claim 16 wherein the closure element is initially positioned in an opened position and is rotated to a closed position to cover an opening formed in the lid by rupturing the scored opening.

* * * * *